US005308531A

United States Patent [19]

Urfer et al.

[11] Patent Number: 5,308,531

[45] Date of Patent: May 3, 1994

[54] PINE-OIL CONTAINING HARD SURFACE CLEANING COMPOSITION

[75] Inventors: Allen D. Urfer, Lansdale; Virginia L. Lazarowitz, Hatfield, both of Pa.

[73] Assignee: Henkel Corporation, Plymouth Meeting, Pa.

[21] Appl. No.: 938,734

[22] Filed: Aug. 31, 1992

[51] Int. Cl.[5] ..... C11D 3/22; C11D 1/04; C11D 3/18; C11D 17/00

[52] U.S. Cl. ..... 252/174.17; 252/162; 252/170; 252/174.19; 252/DIG. 14

[58] Field of Search ..... 252/174.17, 174.19, 252/162, 170, DIG. 14

[56] References Cited

U.S. PATENT DOCUMENTS

| | | | |
|---|---|---|---|
| 4,414,128 | 11/1983 | Goffinet | 252/111 |
| 4,627,931 | 12/1986 | Malik | 252/153 |
| 4,663,071 | 5/1987 | Bush et al. | 252/174.19 |
| 4,780,234 | 10/1988 | Malik et al. | 252/135 |
| 4,976,885 | 12/1990 | Wisotzki et al. | 252/174.17 |
| 5,025,069 | 6/1991 | Deguchi et al. | 252/174.17 |
| 5,073,293 | 12/1991 | Deguchi et al. | 252/174.17 |

FOREIGN PATENT DOCUMENTS

| | | |
|---|---|---|
| 1-144495 | 6/1989 | Japan . |
| 1-182400 | 7/1989 | Japan . |
| 2-032197 | 2/1990 | Japan . |
| 3-269097 | 11/1991 | Japan . |

OTHER PUBLICATIONS

*McCutcheon's Emulsifiers & Detergents,* vol. 1, North American Ed., International Ed., 1991, p. 25 (no month available).

U.S. Sir H269, Malik, May 1987.

U.S. Sir H468, Malik et al. May 1988 Chemical Abstracts.

Registry Number 8002-09-3 definition—Pine Oil, 1993 (no month available).

*Primary Examiner*—Christine Skane

*Assistant Examiner*—A. Hertzog

*Attorney, Agent, or Firm*—Ernest G. Szoke; Wayne C. Jasechke; John E. Drach

[57] ABSTRACT

Concentrated hard surface cleaning compositions containing pine oil and/or terpenes and nonionic and a anionic surfactants can be obtained as clear liquids which remain clear when diluted with water.

6 Claims, No Drawings

PINE-OIL CONTAINING HARD SURFACE CLEANING COMPOSITION

BACKGROUND OF THE INVENTION

1. Field of the Invention

This invention relates to hard surface cleaning compositions which contain pine oil.

2. Description of the Related Art

Hard surface cleaning compositions are a relatively specialized category of cleaning compositions. A hard surface cleaning composition is specifically designed or formulated such that it can be applied to a soiled hard surface of interest (e.g., glass, painted walls, woodwork, etc.) and removed therefrom (for example as by wiping with a dry or damp cloth) without a subsequent rinsing operation and without leaving a significant or unsightly residual film upon the surface after cleaning. In many instances, hard surface cleaners contain substances which will aid in cutting grease such as pine oil or terpenes. One of the problems associated with formulating hard surface cleaning compositions which contain pine oils and/or terpenes is the difficulty in solubilizing the pine oils and/or terpenes. It has been found that hard surface cleaners which contain terpenes such as d-limonene or pine oil must incorporate such substances as isopropyl alcohol or glycol ethers. However, these types of compounds also impart high VOC (Volatile Organic Compounds) values to the compositions. Commercial products which exhibit high VOC values are coming under increasing scrutiny and restriction by federal and state regulatory statutes.

U.S. Pat. No. 5,025,069 teaches a low irritant, mild detergent composition which comprises, as essential components: (a) an alkyl glycoside; (b) a surface active agent containing sulfate and/or sulfonate group; (c) an amine oxide; (d) an ethoxylated surface active agent at a specific ratio; (e) a terpene type hydrocarbon; and, (f) 3-isothiazolone or its derivative. A technical information bulletin published by Stepan Company, Northfield, Ill. teaches the use of d-limonene in concentrated, all purpose cleaning formulations. The formulations contain d-limonene and nonionic and/or anionic surfactants. There is no teaching of compositions containing alkyl polyglycosides as the nonionic surfactant. There is also no teaching of compositions which contain a combination of a terpene such as d-limonene and pine oil. Prior to the present invention, it had been observed that hard surface cleaners comprised only of pine oil and a nonionic and/or an anionic surfactant, without other components such as those found in the prior art, did not give clear, single phase product whether concentrated, or diluted with water. Prior to the present invention it was necessary to formulate hard surface cleaning compositions which contain pine oil and only nonionic and/or anionic surfactants by incorporating compounds which impart high VOC values to the compositions such as isopropyl alcohol and glycol ethers in order to solubilize the pine oil. Thus, a need exists for a hard surface cleaning composition containing pine oil or pine oil in combination with one or more terpenes which does not contain materials which are volatile organic compounds such as isopropyl alcohol and glycol ethers which impart high VOC values to the cleaning compositions.

SUMMARY OF THE INVENTION

In accordance with the present invention, there is provided concentrated hard surface cleaning compositions containing pine oil or pine oil and terpenes and nonionic and anionic surfactants which are clear liquids and which remain clear when diluted with water. Such compositions contain a dicarboxylic acid, an alkyl polyglycoside, and pine oil or pine oil and a terpene such as d-limonene and avoid the use of compounds which impart high VOC values to the compositions such as isopropyl alcohol and glycol ethers.

DESCRIPTION OF THE PREFERRED EMBODIMENTS

Other than in the operating examples, or where otherwise indicated, all numbers expressing quantities of ingredients or reaction conditions used herein are to be understood as modified in all instances by the term "about".

Any commercial pine oil, such as steam-distilled, sulfate, or synthetic pine oil can be used in the composition according to the invention without affecting the clarity of the concentrated or diluted versions of the compositions according to the invention. The amount of pine oil, terpene, or combinations of pine oil and one or more terpenes which can be used in the compositions according to the invention will vary depending upon the use of the hard surface cleaning composition and will vary from 1% to 50% by weight of the total composition weight.

The dicarboxylic acids which can be used are those which have a minimum of 3 carbon atoms such as malonic acid and a maximum of 40 carbon atoms such as dimer acids which are the reaction product of the dimerization of two unsaturated carboxylic acids. For example, a typical dimer which can be used in the practice of the instant invention acids useful in the present invention is a C-36 dicarboxylic acid obtained by the dimerization of two moles of a C-18 unsaturated monocarboxylic acid, such as oleic acid or linoleic acid, or mixtures thereof, e.g., tall oil fatty acids. Examples of dimer acids include but are not limited to Westvaco H240, Empol® 1004, Empol® 1007, Empol® 1008, and Empol® 1016. Azelaic acid, a linear dicarboxylic acid having 9 carbon atoms can also be used. The dicarboxylic acid can be used in any amount which is effective to clarify a mixture of pine oil and an alkyl polyglycoside and will typically be in the pine oil: dicarboxylic acid weight ratio range of 1:10 to 10:1.

The alkyl polyglycosides which can be used in the hard surface cleaning compositions according to the invention have the formula I $$R_4O(R_5O)_a(Z)_b \qquad \text{I}$$

wherein $R_4$ is a monovalent organic radical having from about 6 to about 30 carbon atoms; $R_5$ is divalent alkylene radical having from 2 to 4 carbon atoms; Z is saccharide residue having 5 or 6 carbon atoms; a is a number having a value from 0 to about 12; b is a number having a value from 1 to about 6. APG® and/or Plantaren TM surfactants are commercially available materials and may be obtained from Henkel Corporation, Ambler, Pa., 19002. Examples of APG TM and/or Plantaren TM surfactants include but are not limited to:

1. Glucopon TM 225–an alkylpolyglycoside in which the alkyl group contains 8 to 10 carbon atoms.

2. APG TM 325–an alkyl polyglycoside in which the alkyl group contains 9 to 11 carbon atoms.
3. Glucopon TM 625–an alkyl polyglycoside in which the alkyl groups contains 12 to 16 carbon atoms.
4. APG TM 300–an alkyl polyglycoside substantially the same as the 325 product above but having a different average degree of polymerization.
5 Glucopon TM 600–an alkylpolyglycoside substantially the same as the 625 product above but having a different average degree of polymerization.
6. Plantaren TM 2000–a $C_{8-16}$ alkyl polyglycoside.
7. Plantaren TM 1300–a $C_{12-16}$ alkyl polyglycoside.
8. Plantaren TM 1200–a $C_{12-16}$ alkyl polyglycoside.

Other examples include alkyl polyglycoside surfactant compositions which are comprised of mixtures of compounds of formula I wherein Z represents a moiety derived from a reducing saccharide containing 5 or 6 carbon atoms; a is zero; b is a number from 1.8 to 3; and $R^4$ is an alkyl radical having from 8 to 20 carbon atoms. The composition is characterized in that it has increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and poly-glycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in copending application Ser. No. 07/810,588, filed on Dec. 12, 1991, the entire contents of which are incorporated herein by reference. The amount of the alkyl polyglycoside which can be used will vary with the amount of pine oil and can be determined by one of ordinary skill in the art. The amount will typically be in the alkyl polyglycoside: pine oil weight ratio range of 1:10 to 10:1.

The terpenes which can be used in the compositions according to the invention are monoterpene hydrocarbons and oxygenated mono- and bicyclic terpenes. Examples of monocyclic monoterpene hydrocarbons include but are not limited to α-pinene, α-fenchene, camphene, β-pinene, d-limonene, l-limonene, d,l-limonene, and the like. Examples of oxygenated mono- and bicyclic terpenes include but are not limited to fenchone, α-fenchol, camphor, borneol, isoborneol, citronellol, and the like. The preferred terpene is d-limonene. Pine oil may be used in combination with monoterpene hydrocarbons and/or oxygenated mono- and bicyclic terpenes in the compositions according to the invention.

One preferred embodiment of the composition according to the invention is a hard surface cleaning composition comprising: (a) from about 1% to about 40% by weight of an alkyl polyglycoside of the formula I $$R_4O(R_5O)_{a(Z)b} \qquad \text{I}$$

wherein $R_4$ is a monovalent organic radical having from about 6 to about 30 carbon atoms; $R_5$ is divalent alkylene radical having from 2 to 4 carbon atoms; Z is saccharide residue having 5 or 6 carbon atoms; a is a number having a value from 0 to about 12; b is a number having a value from 1 to about 6; (b) from about 2% to about 50% by weight of pine oil; and (c) from about 2% to about 40% by weight of a dicarboxylic acid having from about 3 to about 40 carbon atoms. Another preferred embodiment of the composition according to the invention is a hard surface cleaning composition comprising: (a) from about 1% to about 40% by weight of APG ® 225; (b) from about 2% to about 50% by weight of pine oil; and (c) from about 2% to about 40% by weight of Westvaco TM H240.

The following examples are meant to illustrate but not to limit the invention.

EXAMPLE 1

The data listed in Table 1 illustrate the effect of solubilizing pine oil in hard surface cleaning compositions by incorporating a dicarboxylic acid such as Westvaco TM H-240 and APG ® 225 and does not contain alcohols or glycol ethers. The compositions containing the dicarboxylic acid and the alkyl polyglucoside afford clear liquids in both the concentrated and dilute forms.

TABLE 1

| | COMPOSITION[9] | | | | | | | | App[10] | |
|---|---|---|---|---|---|---|---|---|---|---|
| # | PO[1] | CDEA[2] | APG ®[3] | SLS[4] | SXS[5] | DCA[6] | 257[7] | LR[8] | C | D |
| 1 | 40 | 20 | 20 | — | — | — | — | — | M | — |
| 2 | 25 | 25 | 25 | — | — | — | — | — | G | — |
| 3 | 33 | 33 | 17 | — | — | — | — | — | G | — |
| 4 | 42 | 8 | 21 | — | — | — | — | 8 | M | — |
| 5 | 15 | — | 10 | 10 | 6 | 6 | — | — | C | C |
| 6 | 23 | — | 13 | — | — | 15 | 13 | — | C | C |

[1]Pine Oil
[2]Nitrene TM 11230, a Cocoyl Diethanolamide.
[3]APG ® 225, 50% solids an alkylpolyglycoside in which the alkyl group contains 8 to 10 carbon atoms.
[4]Sodium Lauryl Sulfate (29% actives)
[5]Sodium Xylene Sulfonate (40% actives)
[6]Westvaco H-240 (40% actives)
[7]N-25-27 is Neodol-25-7
[8]LR is Lorol TM 1214.
[9]Parts by weight
[10]Appearance - C-concentrate; D-diluted with water; M-milky; G-gel; C-clear. Dilutions were made only if the concentrated form of the formulation was clear.

EXAMPLE 2

The composition of formulation 7, given in parts by weight of each component, contained both pine oil and d-limonene in hard surface cleaning formulation and illustrates the effect of incorporating a dicarboxylic acid such as Westvaco H-240 and APG ® 225 on the solubility and hence, the clarity of a formulation. This composition, which contained the dicarboxylic acid and the alkyl polyglucoside but no alcohols or glycol ethers, afforded a clear liquid in both the concentrated and dilute forms.

Formulation 7

28 pine oil
5.5 d-limonene
17 APG ® 225
5.5 Neodol 25-7
44 Westvaco H-240

What is claimed is:

1. A clear, single phase, hard surface cleaning composition consisting essentially of: (a) from about 1% to about 50% by weight of pine oil; (b) an alkyl polyglycoside of the formula I $$R_4O(R_5O)_a(Z)_b$$

wherein $R_4$ is a monovalent organic radical having from about 6 to about 30 carbon atoms; $R_5$ is divalent alkylene radical having from 2 to 4 carbon atoms; Z is saccharide residue having 5 or 6 carbon atoms; a is a number having a value from 0 to about 12; b is a number having a value from 1 to about 6 wherein the weight ratio of alkyl polyglycoside: pine oil is equal to from about 1:10 to about 10:1; and (c) a dicarboxylic acid having from about 3 to about 40 carbon atoms wherein the weight ratio of pine oil: dicarboxylic acid is equal to from about 1:10 to about 10:1.

2. The composition of claim 1 wherein said alkyl polyglycoside is an alkyl polyglycoside in which the alkyl group contains from 8 to 10 carbon atoms.

3. A clear, single phase hard surface cleaning composition consisting essentially of: (a) from about 2% to about 50% by weight of pine oil; (b) from about 1% to about 40% by weight of a compound of the formula I $$R_4O(R_5O)_a(Z)_b \qquad \text{I}$$

wherein $R_4$ is a monovalent organic radical having from about 6 to about 30 carbon atoms; $R_5$ is divalent alkylene radical having from 2 to 4 carbon atoms; Z is saccharide residue having 5 to 6 carbon atoms; a is a number having a value from 0 to about 12; b is a number having a value from 1 to about 6; and (c) from about 2% to about 40% by weight of a dicarboxylic acid having from about 3 to about 40 carbon atoms.

4. The composition of claim 3 wherein said compound of formula I is an alkyl polyglycoside in which the alkyl group contains from 8 to 10 carbon atoms.

5. The composition of claim 3 wherein said diacarboxylic acid ia a C-36 dicarboxylic acid obtained by the dimerization of two moles of a C-18 unsaturated monocarboxylic acid.

6. The composition of claim 3 further comprising up to about 5.5% by weight of d-limonene.

* * * * *